US007621821B2

(12) United States Patent
Tsai et al.

(10) Patent No.: US 7,621,821 B2
(45) Date of Patent: Nov. 24, 2009

(54) GOLF CLUB INTERCHANGING CONNECTION STRUCTURE (I)

(75) Inventors: Liang-Ho Tsai, Kaohsiung (TW); Cheng-Tao Lee, Kaohsiung (TW)

(73) Assignee: Advanced International Multitech Co., Ltd., Kaohsiung (TW)

( * ) Notice: Subject to any disclaimer, the term of this patent is extended or adjusted under 35 U.S.C. 154(b) by 0 days.

(21) Appl. No.: 12/061,995

(22) Filed: Apr. 3, 2008

(65) Prior Publication Data

US 2009/0197695 A1 Aug. 6, 2009

(30) Foreign Application Priority Data

Feb. 5, 2008 (TW) ..... 97202588 U

(51) Int. Cl.
*A63B 53/06* (2006.01)

(52) U.S. Cl. ..... 473/306; 473/307; 473/312

(58) Field of Classification Search ..... 473/288, 473/296, 298–299, 306–307, 312
See application file for complete search history.

(56) References Cited

U.S. PATENT DOCUMENTS 1,540,559 A * 6/1925 Murphy ..... 473/306
1,690,266 A * 11/1928 Barrett ..... 473/312
2,171,483 A * 8/1939 Simonton ..... 473/306
5,513,844 A * 5/1996 Ashcraft et al. ..... 473/288
7,083,529 B2 8/2006 Cackett et al.
7,344,449 B2 * 3/2008 Hocknell et al. ..... 473/307
2008/0167137 A1 * 7/2008 Burnett et al. ..... 473/309

* cited by examiner

*Primary Examiner*—Stephen L. Blau
(74) *Attorney, Agent, or Firm*—Morris, Manning & Martin LLP; Tim Tingkang Xia

(57) ABSTRACT

A golf club interchanging connection structure for interchanging a club head and a shaft, in which a connecting part is in the club head and a female screw is formed in the connecting part, includes a nut hole position part, a club sleeve, and a screw. The nut hole position part includes a male screw on an outer surface thereof and a flange. The flange includes a leaning surface and a positioning hole. The male screw is screwed with the female screw in the connecting part. The club sleeve is placed within the connecting part and has one end being fixed with the shaft and the other end having a nut hole. The screw including a screw head is positioned through the positioning hole and screwed with the nut hole, and the screw head leans against the leaning surface to lock the shaft connected to the club sleeve.

7 Claims, 3 Drawing Sheets

GOLF CLUB INTERCHANGING CONNECTION STRUCTURE (I)

This application claims the benefit of Taiwan Patent Application No. 097202588, filed on Feb. 5, 2008, which is hereby incorporated by reference for all purposes as if fully set forth herein.

BACKGROUND OF THE INVENTION

1. Field of the Invention

The present invention relates to a golf club interchanging connection structure, and more particularly to an interchanging connection structure for interchanging a club head and a shaft of a golf club.

2. Related Art

As the golf sport develops vigorously, the structure and material of the golf club have also developed accordingly. In order to cater to each golfer, and to enable the golfer to select a suitable combination of a club head and a shaft according to the specific state during striking, golf-club manufacturers exert their efforts in developing a golf club with a quick head-shaft interchanging function.

Referring to FIG. 1, it is a schematic view of a conventional golf club interchanging connection structure. In U.S. Pat. No. 7,083,529, a golf club 10 with a quick interchanging function is proposed, which includes a club head 12 and a shaft 14, and the club head 12 and the shaft 14 are interchanged quickly through an interchanging connection structure 16. The interchanging connection structure 16 includes a club sleeve 18, a tube seat 20, and a screw 22. One end of the club sleeve 18 has an opening 24, the shaft 14 is placed into the opening 24 and bonded in the club sleeve 18. The tube seat 20 is embedded into the club head 12 and bonded in the club head 12. After the club sleeve 18 is placed into the tube seat 20, the screw 22 is used to lock the club sleeve 18 to the tube seat 20, so as to quickly interchange the club head 12 and the shaft 14.

However, when the internal portion of the tube seat 20 becomes deformed since the club head 12 is influenced by the outside force, such as collision, the club sleeve 18 may be hard to be placed into the tube seat 20. Since the tube seat 20 in the conventional art is embedded in the club head 12 and fixed by bonding, it will be very difficult to repair or replace the tube seat 20.

SUMMARY OF THE INVENTION

Accordingly, in order to solve the above problems, the present invention is directed to a golf club interchanging connection structure, in which a male screw of a nut hole position part is screwed with a female screw in a connecting part of a club head, which is helpful to disassemble the nut hole position part for executing repair or replacement when the nut hole position part is broken.

In order to achieve the objective, the present invention provides a golf club interchanging connection structure, which is applied for interchanging a club head and a shaft of a golf club. Therein, a connecting part is formed or jointed in the club head and a female screw is formed in the connecting part. The golf club interchanging connection structure includes a nut hole position part, a club sleeve, and a screw. The nut hole position part includes a flange and a male screw on an outer surface of the nut hole position part. The flange includes a leaning surface and a positioning hole located in the leaning surface, and the male screw is screwed with the female screw in the connecting part. The club sleeve is placed within the connecting part and has one end being connected to and fixed with the shaft and the other end having a nut hole. The screw including a screw head is positioned through the positioning hole and screwed with the nut hole of the club sleeve, and the screw head leans against the leaning surface to lock the shaft connected to the club sleeve.

With the golf club interchanging connection structure of the present invention, the male screw of the nut hole position part is screwed with the female screw in the connecting part of the club head, which is helpful to disassemble the nut hole position part for executing repair or replacement when the nut hole position part is broken.

BRIEF DESCRIPTION OF THE DRAWINGS

The present invention will become more fully understood from the detailed description given herein below for illustration only, which thus is not limitative of the present invention, and wherein.

DETAILED DESCRIPTION OF THE INVENTION

In order to make the objective, structure, and function of the present invention be more comprehensible, a detailed description is given below with reference to the embodiments and accompanying drawings.

Figure 1:
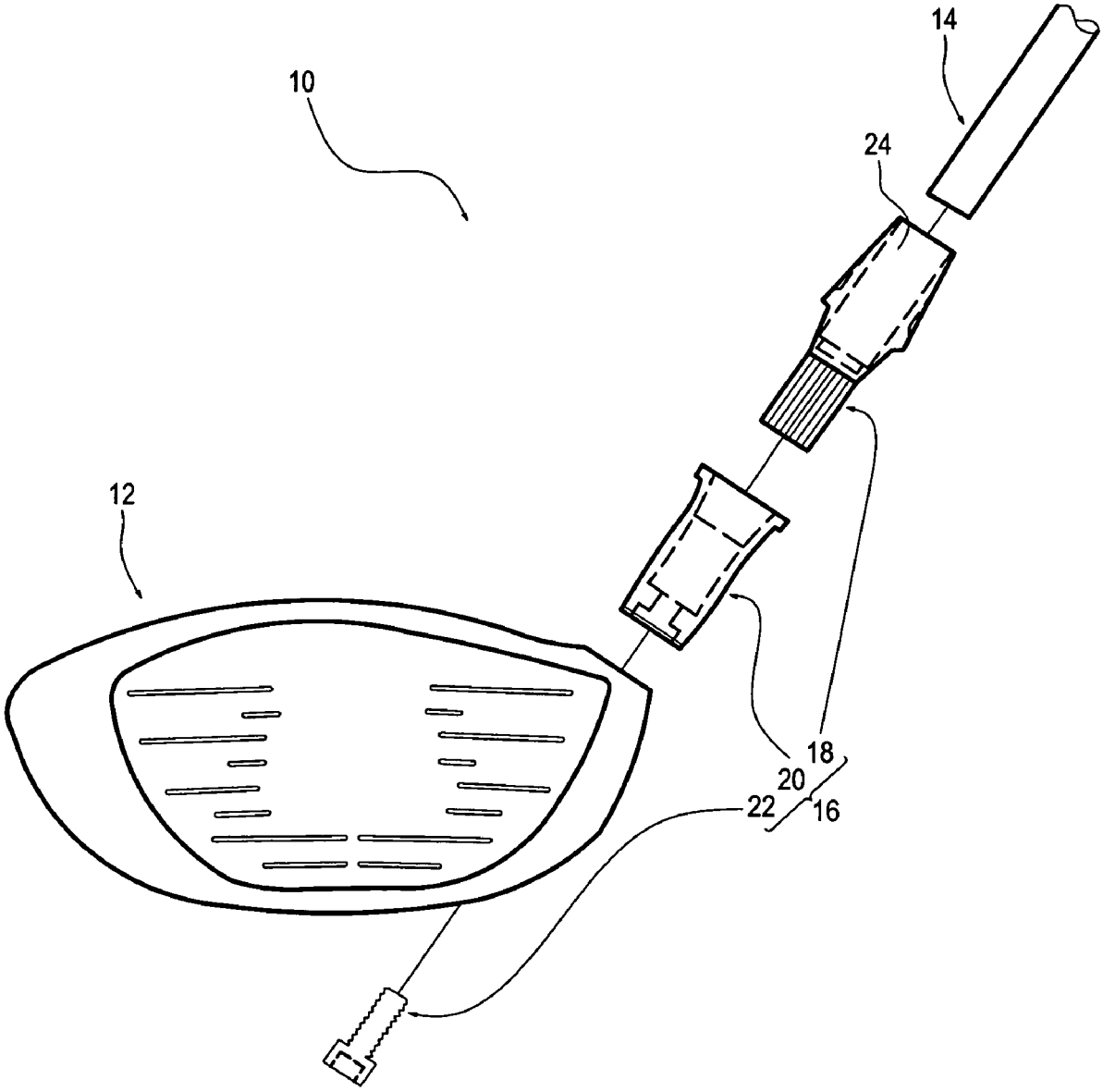
FIG. 1 is a schematic view of a conventional golf club interchanging connection structure.
Figure 2:
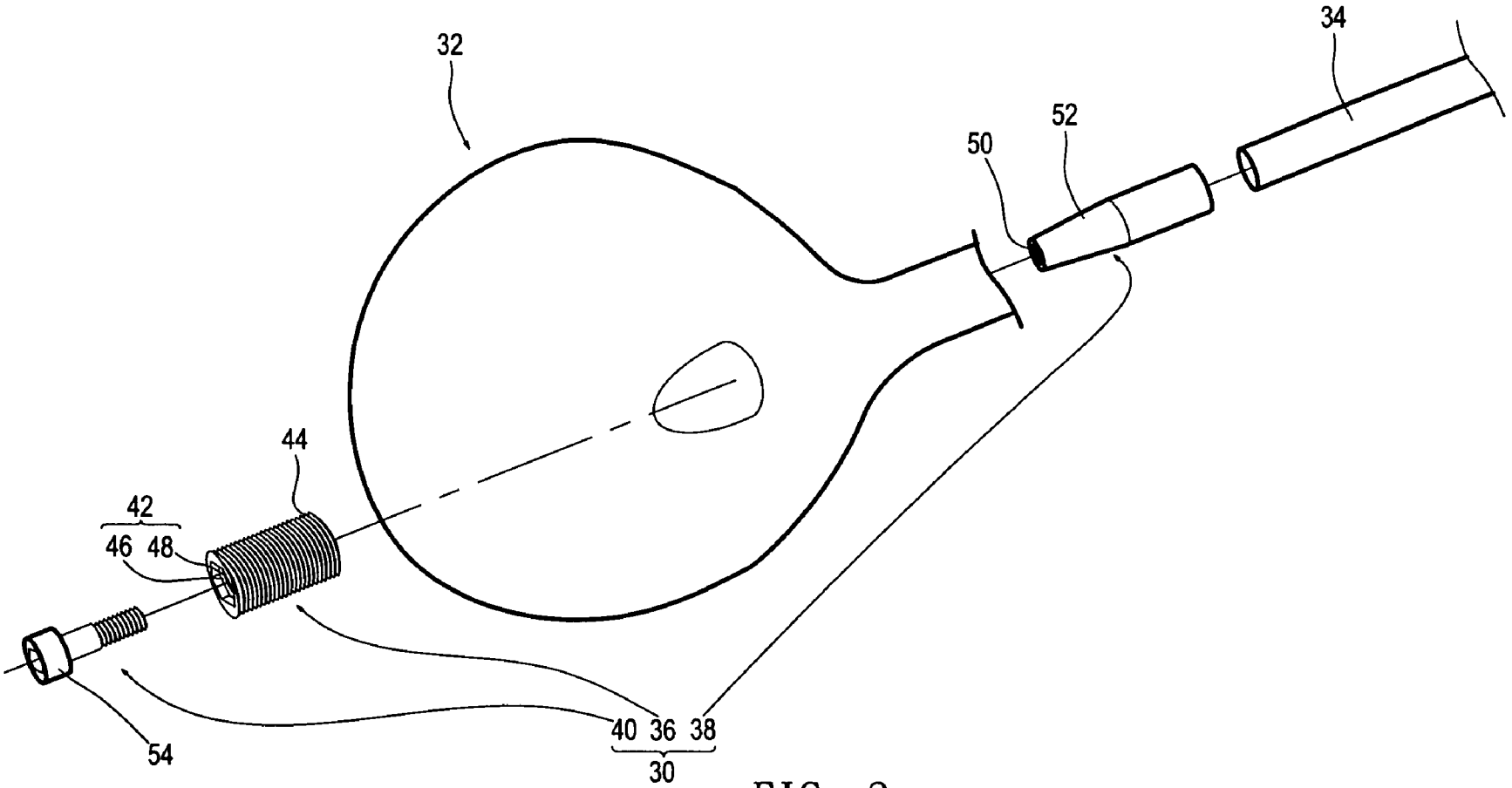
FIG. 2 is an exploded view of a golf club interchanging connection structure according to an embodiment of the present invention.

Referring to FIG. 2, it illustrates an exploded view of a golf club interchanging connection structure according to an embodiment of the present invention. The golf club interchanging connection structure 30 in the embodiment of the present invention is used to interchange a club head 32 and a shaft 34 of a golf club, in which a connecting part (not shown in FIG. 2) is formed or jointed in the club head 32 and a female screw (not shown in FIG. 2) is formed in the connecting part.

The golf club interchanging connection structure 30 in the embodiment of the present invention includes a nut hole position part 36, a club sleeve 38, and a screw 40. Therein, the nut hole position part 36, which is made of, for example, iron, stainless steel, pure titanium, titanium alloy, aluminum, or aluminum alloy, includes a flange 42 and a male screw 44 on an outer surface of the nut hole position part 36. The flange 42 of the embodiment is formed inside the nut hole position part 36, and includes a leaning surface 46 and a positioning hole 48 located in the leaning surface 46. The male screw 44 corresponds to the female screw in the connecting part. It should be noted that, a flange could be formed on one end of a nut hole position part in other embodiments, and a leaning surface is a surface of the nut hole position part.

One end of the club sleeve 38 is connected to and fixed with the shaft 34 and the other end includes a nut hole 50. Therein, the end of the club sleeve 38 having the nut hole 50 is configured into a tapered shape 52. In addition, the club sleeve 38 is made of, for example, iron, stainless steel, pure titanium, titanium alloy, aluminum, or aluminum alloy.

The screw 40, which is made of, for example, iron, stainless steel, pure titanium, titanium alloy, aluminum, or aluminum alloy, includes a screw head 54. The screw 40 corresponds to the nut hole 50 of the club sleeve 38.

Figure 3:
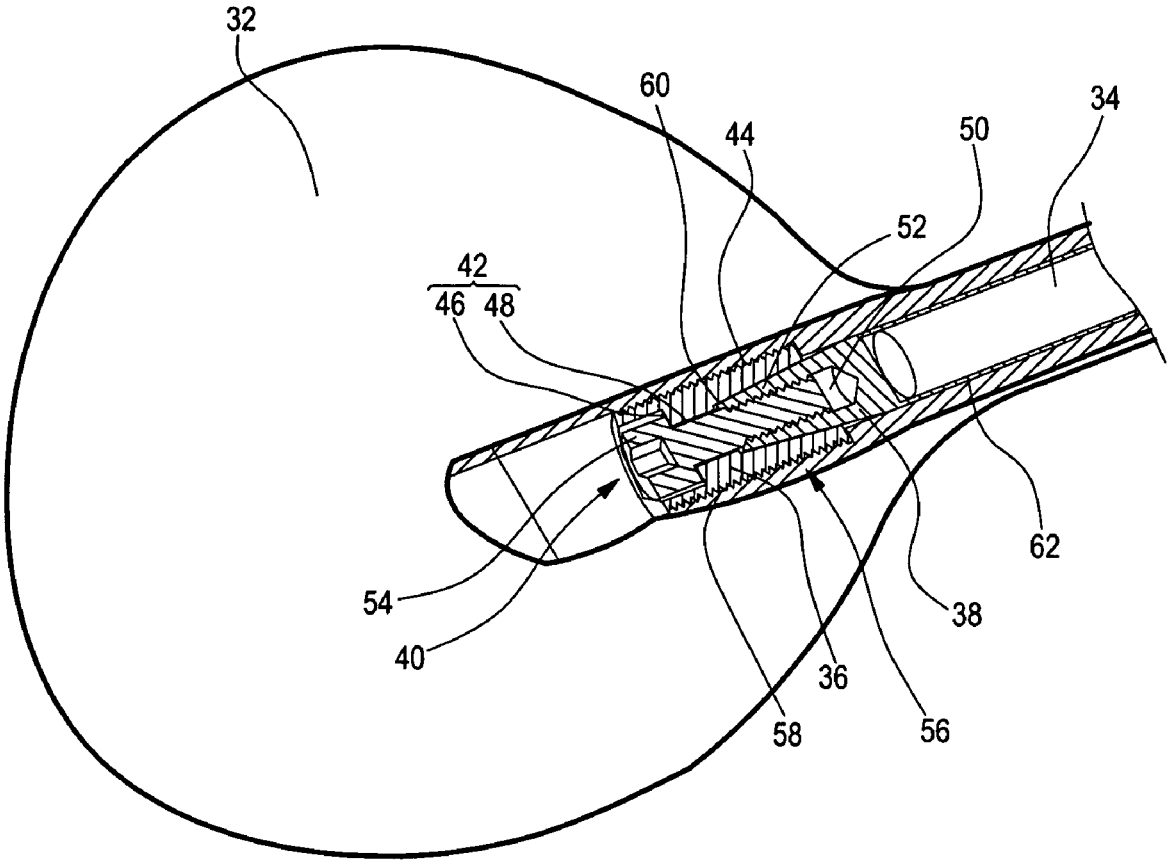
FIG. 3 is a cross-sectional view of connecting a club head with a shaft through the golf club interchanging connection structure according to the embodiment of the present invention.

Referring to FIG. 3, it illustrates a cross-sectional view of connecting the club head with the shaft through the golf club interchanging connection structure according to the embodiment of the present invention. The male screw 44 on the outer surface of the nut hole position part 36 is screwed with the female screw 58 of the connecting part 56. Therein, a tapered slot 60 is located in the nut hole position part 36, and its inner diameter of one end close to the flange 42 is smaller than that of the other end away from the flange 42. The tapered slot 60 corresponds to the end of the club sleeve 38, which is configured into the tapered shape 52.

Afterward, the club sleeve 38 is placed within the connecting part 56, in which the end configured into the tapered shape 52 is placed into the tapered slot 60 of the nut hole position part 36. In addition, the club sleeve 38 has an accommodation space 62 corresponding to the shaft 34, and the shaft 34 is placed into the accommodation space 60 and bonded or welded to the club sleeve 38. It should be noted that, the club sleeve 38 closely contacts with an inner surface of the connecting part 56 in the club head 32 to increase a rotation-resistant force for the shaft 34 and the club head 32.

The screw 40 is positioned through the positioning hole 48 and screwed with the nut hole 50 of the club sleeve 38 to lock the end of the club sleeve 38 in the tapered slot 60 of the nut hole position part 36, and the screw head 54 leans against the leaning surface 46 to lock the shaft 34 connected to the club sleeve 38. In addition, The present invention could further include a gasket (not shown in FIG. 3) placed between the screw 40 and the leaning surface 46 to increase a rotation-resistant force for the screw 40 and the club sleeve 38.

As compared with the conventional art, in the golf club interchanging connection structure of the present invention, the male screw of the nut hole position part is screwed with the female screw in the connecting part formed or jointed in the club head, which is helpful to disassemble the nut hole position part for executing repair or replacement when the nut hole position part is broken. Furthermore, when the interior of the club head becomes deformed, it only needs to shape the connecting part in the club head according to the structure of the present invention by simply utilizing a shaping knife or a tapping knife for processing.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A golf club interchanging connection structure, for interchanging a club head and a shaft of a golf club, wherein a connecting part is formed or jointed in the club head and a female screw is formed in the connecting part, comprising:

a nut hole position part, comprising a flange and a male screw on an outer surface of the nut hole position part, wherein the flange includes a leaning surface and a positioning hole going through the leaning surface, and the male screw is screwed with the female screw in the connecting part;

a club sleeve, placed within the connecting part, and having one end being connected to and fixed with the shaft and an other end having a nut hole; and a screw, comprising a screw head, wherein the screw is positioned through the positioning hole and screwed with the nut hole of the club sleeve, and the screw head leans against the leaning surface to lock the shaft connected to the club sleeve, wherein a tapered slot is located in the nut hole position part, and its inner diameter of one end close to the flange is smaller than that of an other end away from the flange, and the end having the nut hole of the club sleeve is configured into a tapered shape corresponding to the tapered slot in the nut hole position part, and the screw is screwed with the nut hole of the club sleeve to lock the end of the club sleeve in the tapered slot of the nut hole position part.

2. The golf club interchanging connection structure as claimed in claim 1, wherein the flange is formed inside the nut hole position part.

3. The golf club interchanging connection structure as claimed in claim 1, wherein the flange is formed on one end of the nut hole position part, and the leaning surface is a surface of the nut hole position part.

4. The golf club interchanging connection structure as claimed in claim 1, wherein the club sleeve has an accommodation space corresponding to the shaft, and the shaft is placed into the accommodation space and bonded to the club sleeve.

5. The golf club interchanging connection structure as claimed in claim 1, wherein the club sleeve has an accommodation space corresponding to the shaft, and the shaft is placed into the accommodation space and welded to the club sleeve.

6. The golf club interchanging connection structure as claimed in claim 1, wherein the club sleeve closely contacts with an inner surface of the connecting part in the club head.

7. A golf club interchanging connection structure, for interchanging a club head and a shaft of a golf club, wherein a connecting part is formed or jointed in the club head and a female screw is formed in the connecting part, comprising:

a nut hole position part, comprising a flange and a male screw on an outer surface of the nut hole position part, wherein the flange includes a leaning surface and a positioning hole going through the leaning surface, and the male screw is screwed with the female screw in the connecting part, and wherein a tapered slot is located in the nut hole position part, and its inner diameter of one end close to the flange is smaller than that of another end away from the flange;

a club sleeve, placed within the connecting part, and having one end being connected to and fixed with the shaft and an other end having a nut hole;

a screw, comprising a screw head, wherein the screw is positioned through the positioning hole and screwed with the nut hole of the club sleeve; and a gasket placed between the screw and the leaning surface.

* * * * *